US005775976A

United States Patent [19]

Kremen et al.

[11] Patent Number: 5,775,976

[45] Date of Patent: Jul. 7, 1998

[54] METHOD AND DEVICE FOR MAGNETIC-ABRASIVE MACHINING OF PARTS

[75] Inventors: Gennady Kremen, Brooklyn, N.Y.; Savva Feigyn; Leonid Igelshteyn, both of Manalapan, N.J.

[73] Assignee: Scientific Manufacturing Technologies, Inc., Brooklyn, N.Y.

[21] Appl. No.: 827,158

[22] Filed: Mar. 27, 1997

[51] Int. Cl.[6] ..... B24B 1/00; B24C 1/00

[52] U.S. Cl. ..... 451/36; 451/37; 451/93

[58] Field of Search ..... 451/28, 36, 93, 451/37, 317, 103, 104, 106, 113, 114, 38, 40, 60, 39

[56] References Cited

U.S. PATENT DOCUMENTS

| | | | |
|---|---|---|---|
| 3,695,934 | 10/1972 | Feldhaus | 451/36 |
| 4,175,930 | 11/1979 | Sakulevich et al. | 451/36 |
| 4,306,386 | 12/1981 | Sakulevich et al. | 451/36 |
| 4,821,466 | 4/1989 | Kato et al. | 451/36 |
| 4,977,707 | 12/1990 | Chachin et al. | 451/37 |
| 5,419,735 | 5/1995 | Imahashi et al. | 45/36 |
| 5,449,313 | 9/1995 | Kordonsky et al. | 451/36 |
| 5,569,061 | 10/1996 | Kremen | 451/93 |
| 5,577,948 | 11/1996 | Kordonsky et al. | 451/36 |

FOREIGN PATENT DOCUMENTS

| | | | |
|---|---|---|---|
| 402048169 | 2/1990 | Japan | 451/93 |
| 1703413 | 1/1992 | U.S.S.R. | 451/93 |

*Primary Examiner*—Timothy V. Eley
*Assistant Examiner*—Derris H. Banks
*Attorney, Agent, or Firm*—Ilya Zborovsky

[57] ABSTRACT

A magnetic-abrasive machining of a part includes generating a magnetic field; introducing a part to be machined into the magnetic field; supplying a magnetic-abrasive powder into a machining zone toward a surface of the part to be machined; and generating a vacuum between the magnetic-abrasive powder and the surface of the part to be machined so that the magnetic-abrasive powder is moved relative to the surface of the part to be machined.

12 Claims, 5 Drawing Sheets

METHOD AND DEVICE FOR MAGNETIC-ABRASIVE MACHINING OF PARTS

BACKGROUND OF THE INVENTION

The present invention relates to a method and device for magnetic-abrasive machining of parts.

Magnetic-abrasive machining of parts are known in the art. In the process of the magnetic-abrasive machining a magnetic-abrasive powder in a magnetic field is held to a part to be machined and provides a material removal. However, the known magnetic-abrasive machining methods and devices are characterized by a low material removal rate.

In order to increase the material removal rate it was proposed in U.S. Pat. No. 5,569,061 to supply a fluid jet to the magnetic-abrasive powder so as to press the magnetic-abrasive powder against a surface of the part to be machined. Therefore, the material removal rate is increased. It is advisable to provide further methods for increasing the material removal rates.

SUMMARY OF THE INVENTION

Accordingly, it is an object of present invention to provide a method and a device for magnetic-abrasive machining which is a further improvement of the existing methods and devices.

In keeping with these objects and with others which will become apparent hereinafter, one feature of the present invention resides, briefly stated in a method of magnetic-abrasive machining in accordance in which a vacuum is produced between a magnetic-abrasive powder and a surface of the part to be machined so that the magnetic-abrasive powder is moved against the surface of the part to be machined. The corresponding device has means for producing a vacuum for this purpose.

In accordance with a further advantageous feature of present invention, in the inventive method of magnetic-abrasive machining an additional fluid jet is directed toward the magnetic-abrasive powder so that the magnetic-abrasive powder is pressed against a surface of the part to be machined by the vacuum and/or displaced with a high speed under the action of the fluid jet supplied under pressure relative to the surface of the part to be machined.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
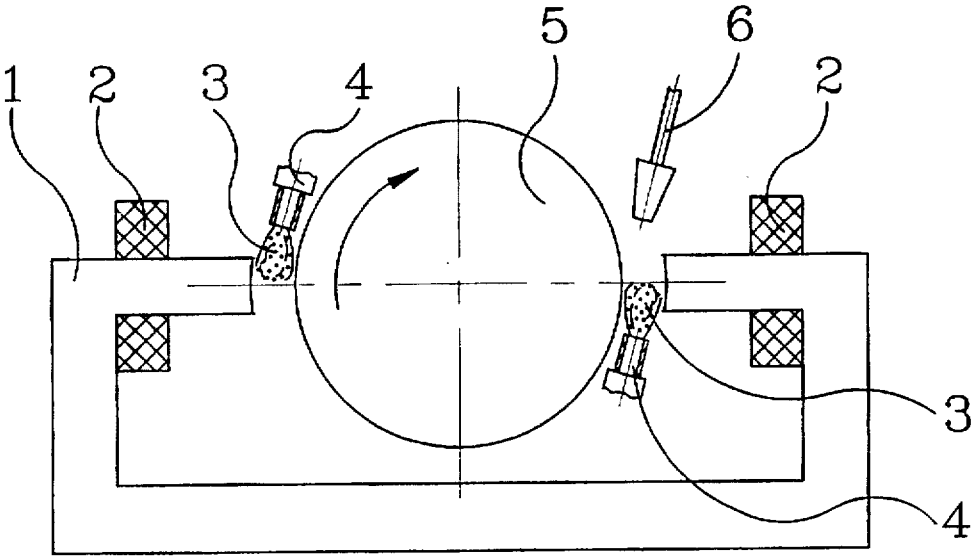
FIG. 1 is a view showing a device for magnetic-abrasive machining in accordance with the present invention.

The device for a magnetic-abrasive machining in accordance with the present invention has a frame or yoke which is identified as a whole with reference numeral 1. Electromagnetic coils 2 are arranged on short horizontal legs of the frame 1 which form pole shoes. A magnetic field is therefore generated between them. A part 5 to be machined is introduced into a machining zone in the magnetic field. Then a magnetic-abrasive powder 3 is supplied into gaps between the part 5 and the pole shoes. During rotation of the part 5 and its reciprocating movement in the axial direction the magnetic-abrasive powder 3 provides a material removal from a surface of the part.

In accordance with the present invention, a vacuum is produced near the surface of the part to be machined. For this purpose, nozzles 4 connected with a not shown source of vacuum are directed toward an area between the magnetic-abrasive powder and the surface of the part 5 to be machined. In particular, the openings of the nozzles 4 are directed to this area. Since the vacuum is produced between the inner most layers of the magnetic-abrasive powder and the outer surface of the part, the outer layers of the magnetic-abrasive powder press the inner layers toward the of the part 5 and a material removal rate is increased. Reference numeral 6 identifies a nozzle for supplying a cooling liquid.

Figure 2:
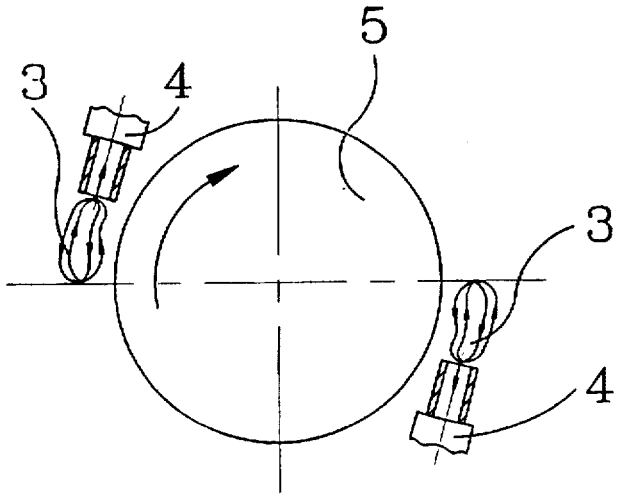
FIG. 2 is an enlarged schematic view of the part to be machined with elements of the inventive device.
Figure 3:
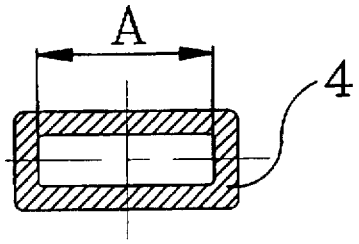
FIG. 3 is a view showing a cross-section of a nozzle for the device in accordance with the present invention.

As shown in FIG. 2 the direction of vacuum coincides with direction of migration of the grains of the magnetic-abrasive powder in the inner most layer which is the closest to the surface of the part 5 to be machined. Therefore the friction of the magnetic-abrasive powder against the surface of the part to be machined is increased. Finally, the created vacuum removes the cooling liquid from a gap between the magnetic-abrasive powder and the surface of the part. Therefore the vacuum increases a pressure of the magnetic-abrasive powder to the surface of the part, increases the friction between the inner most layers of the magnetic-abrasive powder and the surface of the part, and removes the cooling liquid, thus substantially increasing the material removal rate.

In order to produce vacuum, known vacuum pumps are utilized such as for example a vacuum blower or a wet/dry vacuum. The wet/dry vacuums are especially suitable since they usually operate for aspiration of liquid and therefore efficiently aspirate the cooling liquid as was explained hereinabove.

Figure 4:
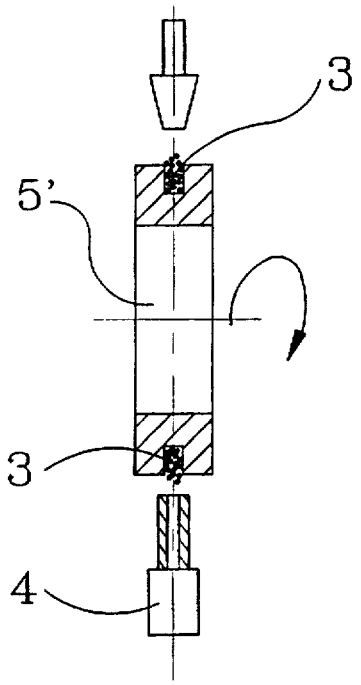
FIG. 4 is a view showing a magnetic-abrasive machining of an outer groove in a ceramic part for a mating O-ring.
Figure 5:
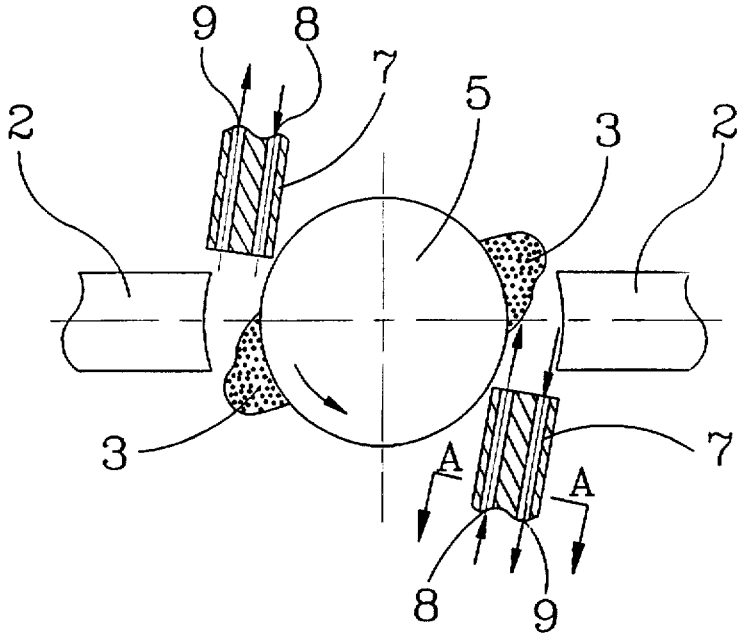
FIG. 5 is a view showing a device in accordance with another embodiment of the present invention.
Figure 6:
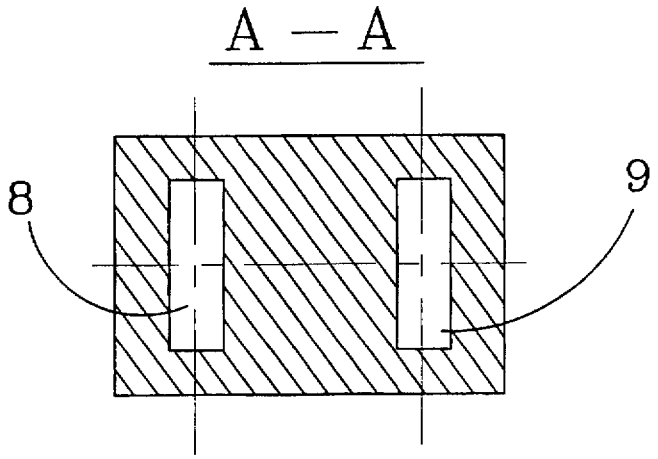
FIG. 6 is a view showing a cross-section of a nozzle to be used with the device in accordance with the present invention.

As shown in FIG. 4, the outer groove of a ceramic part 5' for receiving an O ring can be machined in accordance with the inventive method. Here the width of the groove in the part 5' corresponds to the transverse size of a slot of the nozzle 4.

In accordance with a further important feature of the present invention, in addition to generating a vacuum, also a fluid jet is supplied to the magnetic-abrasive powder. Here a nozzle 7 is provided to act on the magnetic-abrasive powder. The nozzle 7 has a first passage 8 which communicates with a source of vacuum and which is directed to an area between the magnetic-abrasive powder and the outer surface of the part. Therefore, a vacuum is generated between the magnetic-abrasive powder and the outer surface of the part so that the magnetic-abrasive powder is pressed against the surface of the part, as described hereinabove with corresponding important advantages. The nozzle 7 has another passage 9 which communicates a source of a pressure fluid jet to supply a fluid jet under pressure toward the magnetic-abrasive powder. In particular, the fluid jet is supplied so that the fluid jet moves the magnetic-abrasive powder with a high speed along the surface of the part to be machined. In particular, for the shown cylindrical part 5 the fluid jet moves the magnetic-abrasive powder substantially tangentially relative to the cylindrical surface of the part. The fluid jet can also provide an additional component which additionally presses the magnetic-abrasive powder toward the surface of the part to be machined, for example radially in the drawing. In this embodiment the magnetic-abrasive powder is pressed toward the part and displaced relative to the part so as to provide an exceptionally high material removal rate. It is believed to be clear that it is not necessary to use a single nozzle for generating the vacuum and supplying the fluid jet under pressure. Two different nozzles can be utilized as well for this purpose.

Figure 7:
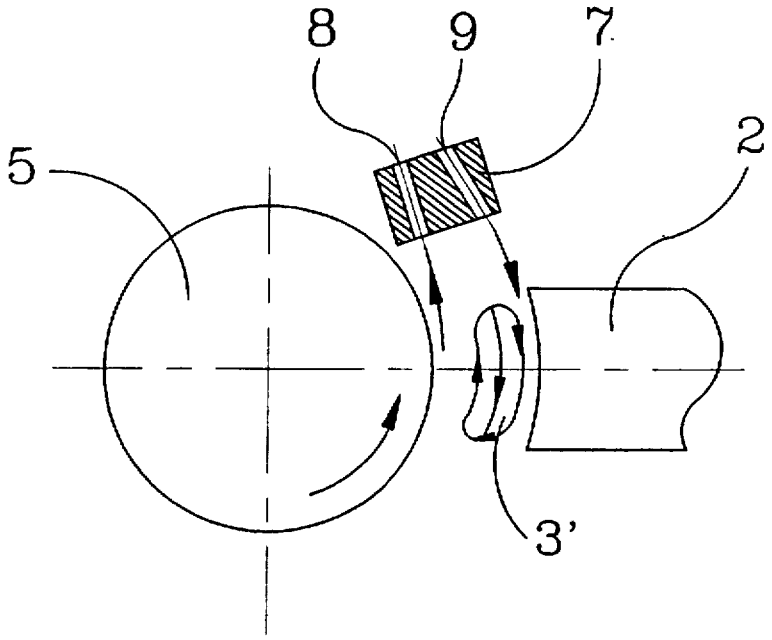
FIGS. 7 and 8 are views showing a method for magnetic-abrasive machining in accordance with another embodiment and a nozzle provided for the same.
Figure 8:
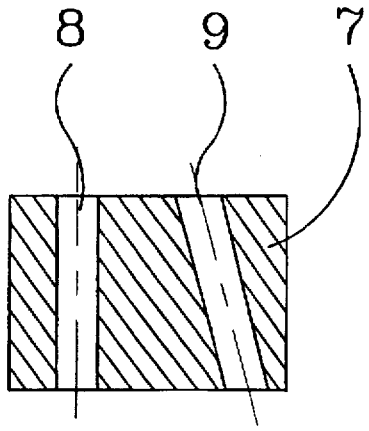

In the embodiment of FIGS. 7 and 8, the nozzle 7 also is provided with a further passage 8 communicating with a source of vacuum and a second passage 9 communicating with a source of a pressure fluid jet. The nozzle 7 and its passages are arranged relative to the part 5 to be machined and to the pole shoe 2 so that a vortex of rotatable magnetic-abrasive powder 3' is formed between the pole shoe and the part. In this wartex the magnetic-abrasive powder rotates with a very high speed. The vacuum applied through the passage 8 provides pressing of the magnetic-abrasive powder to the surface of the part, spinning of the magnetic-abrasive powder, contacting with the surface of the part to remove moisture, and its direction coincides with the direction of rotation of the part. The fluid jet supplied through the passage 9 conditionally spins the magnetic-abrasive powder, in contacts with a surface of the pole shoe 2, removes the magnetic-abrasive powder from the pole shoe if the part 5 is non-magnetic and the magnetic-abrasive powder is magnetically attracted to the pole shoe and not to the part.

Figure 9:
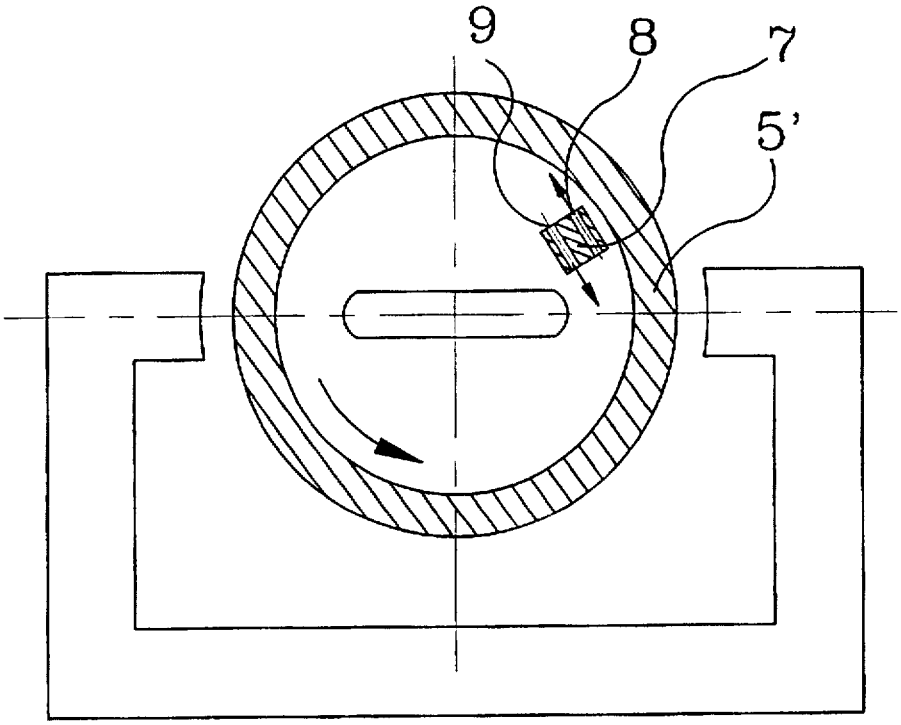
FIGS. 9 and 10 are views showing the method of magnetic-abrasive machining of a hollow part and a flat part.
Figure 10:
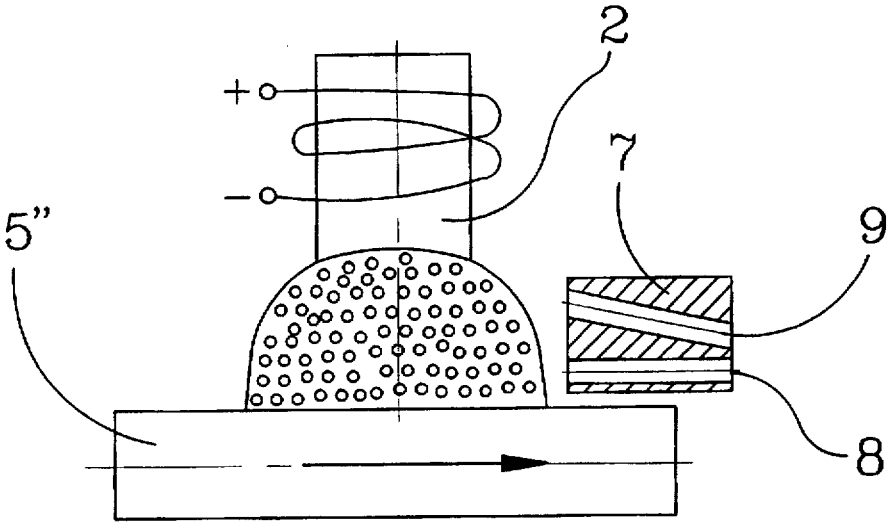

FIG. 9 shows machining of an inner surface of a hollow part 5'. The nozzle 7 is formed similarly to the nozzle shown in FIG. 8 and operates in the same manner. FIG. 10 shows machining of a flat part 5'. While in the embodiment of FIG. 9 the nozzle is located inside the part and substantially tangentially relative to its inner surface, the nozzle 7 in the embodiment of FIG. 10 extends substantially parallel above the upper surface of the part 5".

Figure 11:
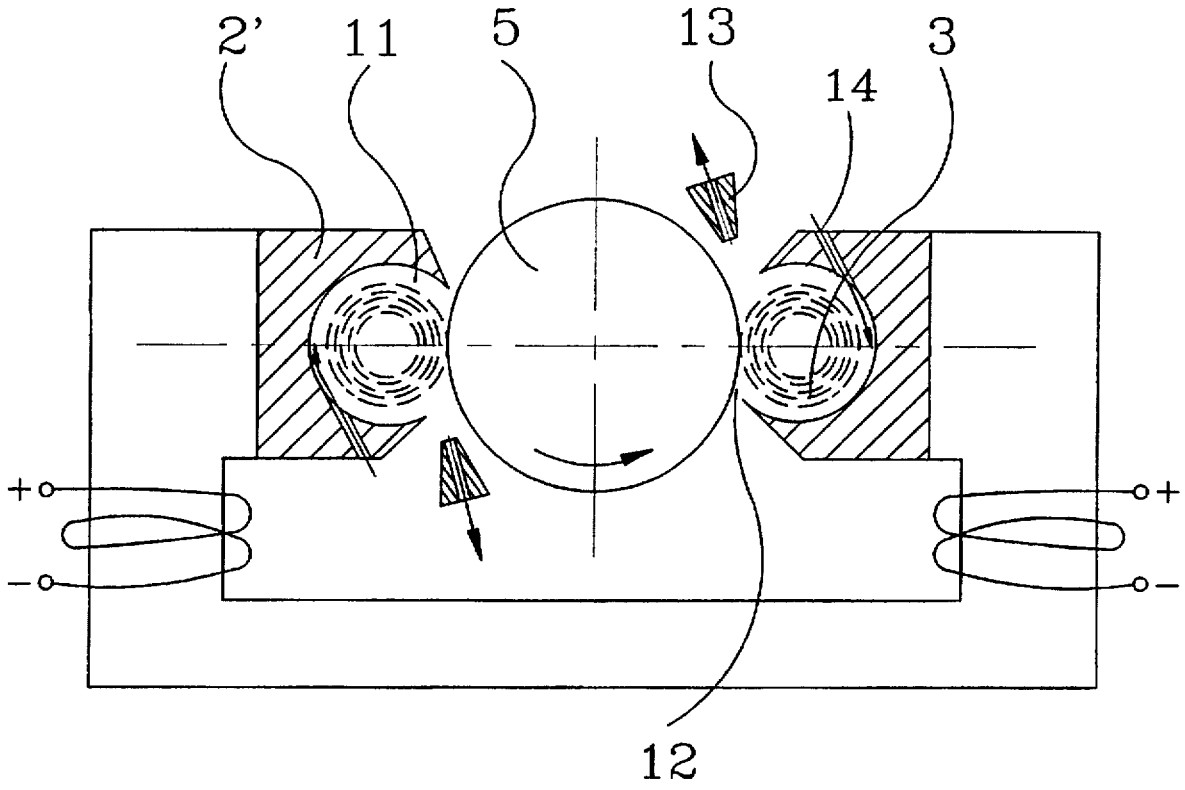
FIG. 11 is a view showing a further modification of the inventive method and device.

FIG. 11 shows a further modification of the present invention. Here the pole shoe 2' has an inner substantially cylindrical chamber 11 with an open side 12. A vacuum is applied by a vacuum nozzle 1 in the region between the magnetic-abrasive powder and the surface part 5, while a fluid jet is supplied through a narrow inclined slot into the inner chamber 11. The magnetic-abrasive powder 3 here forms a wartex under the action of the vacuum and fluid jet, in which the magnetic-abrasive powder rotates with an exceptionally high speed, imitating a rotatable abrasive tool. The portions of the magnetic-abrasive powder in the region of the opening 12 of the chamber 11 provide for extremely high material-removal rate.

It will be understood that each of the elements described above, or two or more together, may also find a useful application in other types of methods and constructions differing from the types described above.

While the invention has been illustrated and described as embodied in method and device for magnetic-abrasive machining of parts, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A method of magnetic-abrasive machining of a part, comprising the steps of generating a magnetic field; introducing a part to be machined into the magnetic field; supplying a magnetic-abrasive powder into a machining zone toward a surface of the part to be machined; and generating a vacuum between the magnetic-abrasive powder and the surface of the part to be machined so that the magnetic-abrasive powder is moved relative to the surface of the part to be machined.

2. A method as defined in claim 1, wherein said generating includes generating a vacuum so that the magnetic-abrasive powder is pressed under the action of the vacuum to the surface of the part to be machined.

3. A method as defined in claim, wherein said generating includes generating a vacuum so that the magnetic-abrasive powder is moved under the action of the vacuum relative to the surface of the parts to be machined.

4. A method as defined in claim 3, wherein said generating includes generating a vacuum so that the magnetic-abrasive powder is rotated relative to the surface of the part to be machined.

5. A method as defined in claim 1, wherein said generating includes generating a vacuum so that the magnetic-abrasive powder is pressed under the action of the vacuum to the surface of the part to be machined and also to displaced relative to the surface of the part to be machined.

6. A method as defined in claim 1; and further comprising supplying a fluid jet toward the magnetic-abrasive powder under pressure so as to move the magnetic-abrasive powder relative to the surface of the part to be machined.

7. A device for magnetic-abrasive machining of a part, comprising means for generating a magnetic field; means for introducing a part to be machined in to the magnetic field; means for supplying a magnetic-abrasive powder into a machining zone on a surface of the part to be machined; and means for generating a vacuum between the magnetic-abrasive powder and the surface of the part to be machined so that the magnetic-abrasive powder is moved relative to the surface of the part to be machined.

8. A device as defined in claim 1, wherein said means for generating a vacuum is formed so that the magnetic-abrasive powder is pressed under the action of the vacuum to the surface of the part to be machined.

9. A device as defined in claim 7, wherein said means for generating a vacuum is formed so that the magnetic-abrasive powder is moved under the action of the vacuum relative to the surface of the parts to be machined.

10. A device as defined in claim 7, wherein said means for generating a vacuum is formed so that the magnetic-abrasive powder is rotated relative to the surface of the part to be machined.

11. A device as defined in claim 7, wherein said means for generating a vacuum is formed so that the magnetic-abrasive powder is pressed under the action of vacuum to the surface of the part to be machined and also displaced relative to the surface of the part to be maintained.

12. A device as defined in claim 7; and further comprising means for supplying a fluid jet toward the magnetic-abrasive powder so as to move the magnetic-abrasive powder relative to the surface of the part to be machined.

* * * * *